US005338908A

United States Patent [19]

Rahman et al.

[11] Patent Number: 5,338,908

[45] Date of Patent: Aug. 16, 1994

[54] VENTED PRESSURE SWITCH APPARATUS

[75] Inventors: Aziz Rahman, East Taunton, Mass.; Gary A. Baker, North Scituate, R.I.

[73] Assignee: Texas Instruments Incorporated, Dallas, Tex.

[21] Appl. No.: 73,729

[22] Filed: Jun. 8, 1993

[51] Int. Cl.[5] ..... H01H 35/34

[52] U.S. Cl. ..... 200/83 P; 73/723; 200/302.1; 200/306

[58] Field of Search ..... 92/5 R, 103 M; 307/118; 340/626; 73/717, 723, 861.47; 200/81 R, 81.4, 83 A, 83 R, 83 N, 83 P, 292, 51 R, 302.1, 306

[56] References Cited

U.S. PATENT DOCUMENTS 3,835,271 9/1974 Garrett ..... 200/834
4,006,083 2/1977 Westervelt ..... 210/90
4,853,503 8/1989 Sanford .
4,861,953 8/1989 Sanford .
5,004,876 4/1991 Sogge et al. .
5,015,808 5/1991 Czarn et al. .
5,049,708 9/1991 Baker ..... 200/83 P
5,101,549 4/1992 Sogge et al. .

*Primary Examiner*—Gerald P. Tolin
*Attorney, Agent, or Firm*—Russell E. Baumann; Richard L. Donaldson; Rene E. Grossman

[57] ABSTRACT

A bracket 14 for mounting a lead frame 12 having pressure responsive electrical switches 20 is provided with a pair of bores 88 through the bracket at each switch station in alignment with recessed portions 78 and 86 in the bottom surface of the switch housing. A layer 92 of filter material is disposed between the bores and the recessed portions so that fluid flowing through the bores into the recessed portions will be forced to flow through the filter material to exclude particles of contamination larger than a selected size.

13 Claims, 4 Drawing Sheets

VENTED PRESSURE SWITCH APPARATUS

BACKGROUND OF THE INVENTION

This invention relates generally to pressure switches and more specifically to vented pressure switches adapted for use with hydraulic fluid control lines of a motor vehicle automatic transmission system.

In recent years, it has become conventional in the motor vehicle art to control various engine and power-train functions by means of microprocessor based controls to obtain optimum performance. For example, actuation of valves used to effect transmission gear shifting are sensed by placing normally open and normally closed pressure responsive electrical switches in communication with hydraulic lines so that a change in pressure in such lines which occurs upon valve actuation and de-actuation can be sensed and a suitable electrical signal provided to the microprocessor as a result of the switching. Switch assemblies of this type are shown for example in U.S. Pat. Nos. 4,861,953; 4,853,503; 5,004,876; 5,015,808 and 5,101,549, all assigned to the assignee of the present invention.

The above referenced switches employ a pressure responsive member placed in pressure communication with hydraulic fluid in a control valve line. Upon a selected change in pressure of the fluid the pressure responsive member experiences a change from one configuration to another configuration and in so doing either closes or opens an electrical circuit which is adapted to provide a signal to the microprocessor of the particular change in pressure signifying the switching of a valve and a corresponding change in a transmission function. In order for the switching to be an accurate reflection of the change in pressure it is important that the switches have a consistent response time even with changing temperatures, actuation/release pressures, endurance life and so on. This in turn a hermetic enclosure for the switch contact system or a means for venting the switch contact system if the contact system operates immersed in oil (automatic transmission fluid) or a vented switch. Hermetic enclosures, however are prohibitive from a cost standpoint and therefore it is important to provide some means for venting the switching chamber. Another problem which must be dealt with is the environment of the switches. That is, the switches are mounted either totally immersed in fluid or in areas where they are splashed with fluids on a regular basis. These fluids contain contaminants such as chips or slivers from the transmission gears which are carried by the hydraulic fluid. These contaminants can have an adverse affect on switch operation. Normally open switches are particularly sensitive to contamination with large particles or slivers sometimes bridging the gap between the movable contact member when in the normal open position and the stationary contact thereby giving a false actuation signal to the microprocessor.

It is an object of invention to provide an inexpensive yet reliable pressure responsive electrical switch having improved insensitivity to contamination present in fluid in the switch environs. Another object of the invention is the provision of an improved vented pressure responsive electrical switch.

SUMMARY OF THE INVENTION

Briefly, in accordance with the invention, a pressure switch assembly comprises an overmolded lead frame mounting one or more pressure responsive electrical switches. The lead frame is received on a bracket adapted to be attached to the control valve body of an automatic motor vehicle transmission with the pressure responsive switches biased against respective ports so that they are in pressure communication with hydraulic fluid control lines. The switches comprise first and second housing members sandwiching a combination terminal and disc seat. The first housing has an opening with an O-ring type seal adapted to be received around a port when the switch assembly is mounted on the control valve body and the second housing mounts a stationary contact in a switching chamber. According to a feature of the invention, a plurality of recessed portions are formed on the bottom surface of the second housing member with a sealing rib provided along the outer periphery of each recessed portion to effectively provide a seal with the bracket received over the bottom surface of the second housing members. The recessed portions are alternated with non-recessed portions and recessed portions are preferably diametrically opposed to non-recessed portions. Terminal members extend laterally from diametrically opposed sides of the switch and can be connected to connecting points of the lead frame in either of the two 180° alternate positions. According to a feature of the invention a pair of bores is provided through the bracket for each switch station spaced equidistantly from the two connecting points at the station and on either side of an imaginary line joining the two connecting points of the lead frames. A recessed portion is located in the bottom surface of the second housing 90° from the center of an imaginary line joining the terminal members and a channel is formed through the opposed non-recessed portion joining the two recessed portions contiguous thereto and spaced from the center and having a width to accommodate the other of the pair of bores. All the recesses are in communication with the switching chamber so that a passage extends from outside the bracket, through the bores in the bracket, one recessed portion and the channel and two connecting recessed portions into the switching chamber. The channel is preferably formed in the direction of an arc of a circle so that the switch can assume slightly different angular positions as it is attached to the connecting points of the lead frame with one of the bracket bores still in alignment with the channel. According to a feature of the invention, a layer of filter material having a mesh selected to exclude particles having a minor dimension larger than a selected size is placed between the bracket and the switches so that fluid entering the recessed portions will be required to pass through the layer in a direction perpendicular to the surface of the layer. In a modified embodiment the bores in the mounting bracket are offset from the recessed portions and a layer of filter material having warp and woof threads of a selected diameter and having a selected mesh serves as a density filter and filters the fluid which is required to flow through the weave of the layer generally in a direction parallel to the planes in which the warp and woof threads lie to exclude particles having major and minor dimensions larger than respective selected sizes.

Other objects, advantages and details of the novel and improved pressure switch assembly of this invention appear in the following detailed description referring to the drawings in which.

DESCRIPTION OF THE PREFERRED EMBODIMENTS

Figure 1:
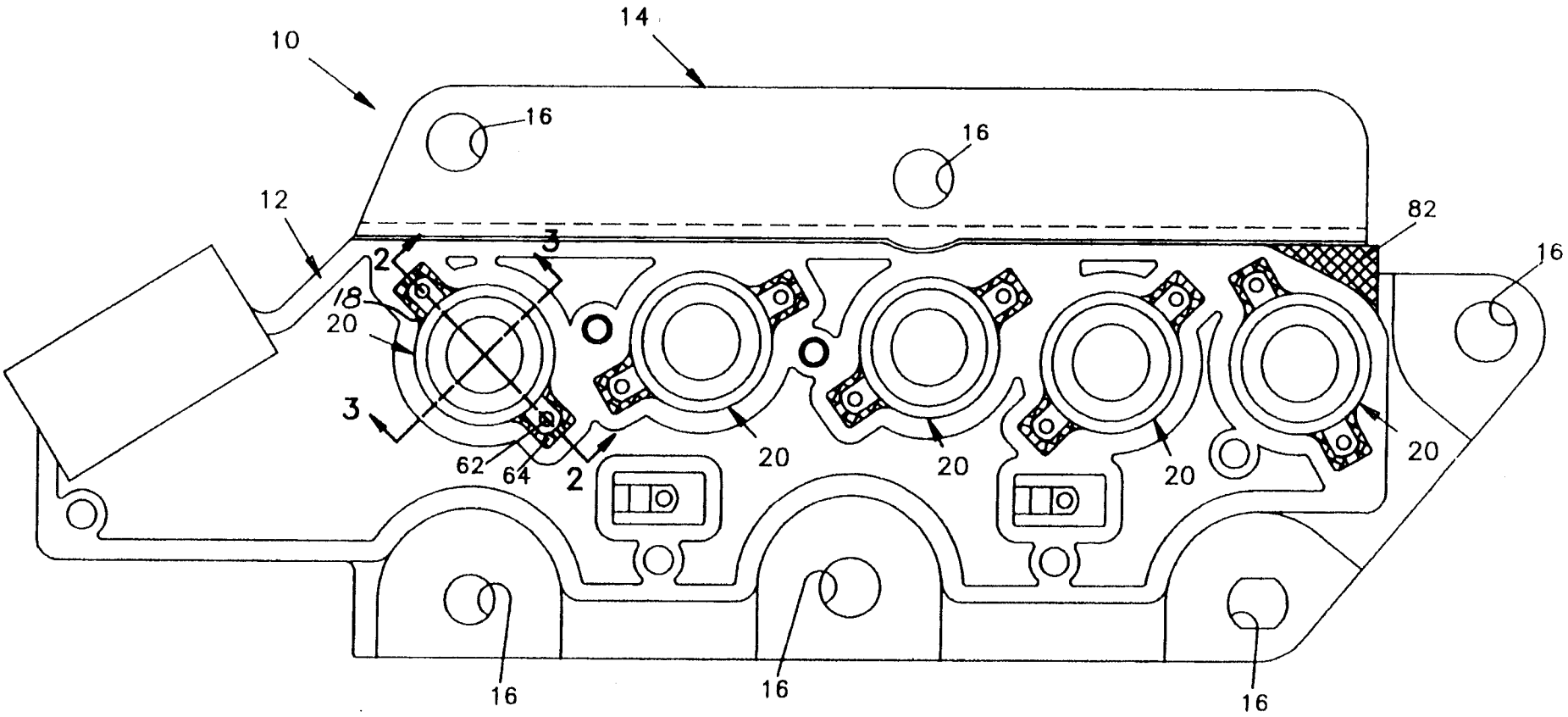
FIG. 1 is a top plan view of a pressure switch assembly made in accordance with the invention.

With reference to FIG. 1 a pressure switch assembly 10 comprises an overmolded lead frame 12 attached to a bracket 14 having mounting holes 16 for mounting the assembly on the housing of a motor vehicle transmission (not shown). A plurality of pressure switches 20 are mounted on overmolded lead frame 12 in apertures 18 and are adapted to be placed in pressure receiving communication with selected hydraulic circuits of a control valve assembly (not shown) via respective ports in the control valve body. The pressure switch assembly of the present invention is particularly adapted for use in a typical front wheel drive transmission where the mounting bracket is positioned above the switch and where the switch is fully immersed when the engine is first started. Fluid must be allowed to exit the switch as the disc, to be discussed below, moves from the position shown in FIG. 3 to its opposite configuration in order for the switch to respond to a valve actuation within a fixed amount of time, for example, in under a second at −40° F. Venting of the switch chamber is required in order for the switch to have a satisfactory response time, particularly at colder temperatures. The switch is also subject to splashing during operation with the fluid following the surface of the mounting bracket with contaminant particles in effect held in suspension due to the turbulence of the fluid so that contamination is even more of a problem than in switches which are entirely immersed in fluid (typical for rear wheel drive transmissions). In copending application Ser. No. 08/073,924 which relates to a similar pressure switch assembly used in applications in which the pressure switches are adapted to be totally immersed in fluid, a venting path is formed remote from the mounting bracket and comprises a tortuous path through offset passageways which interfere with the passage of large contaminant particles into the switching chamber. In accordance with the present invention, the switch assembly is effectively sealed except for a vent passage formed through the mounting bracket into recessed areas of the housing which are in turn in communication with the switching chamber as will be described below.

Figure 2:
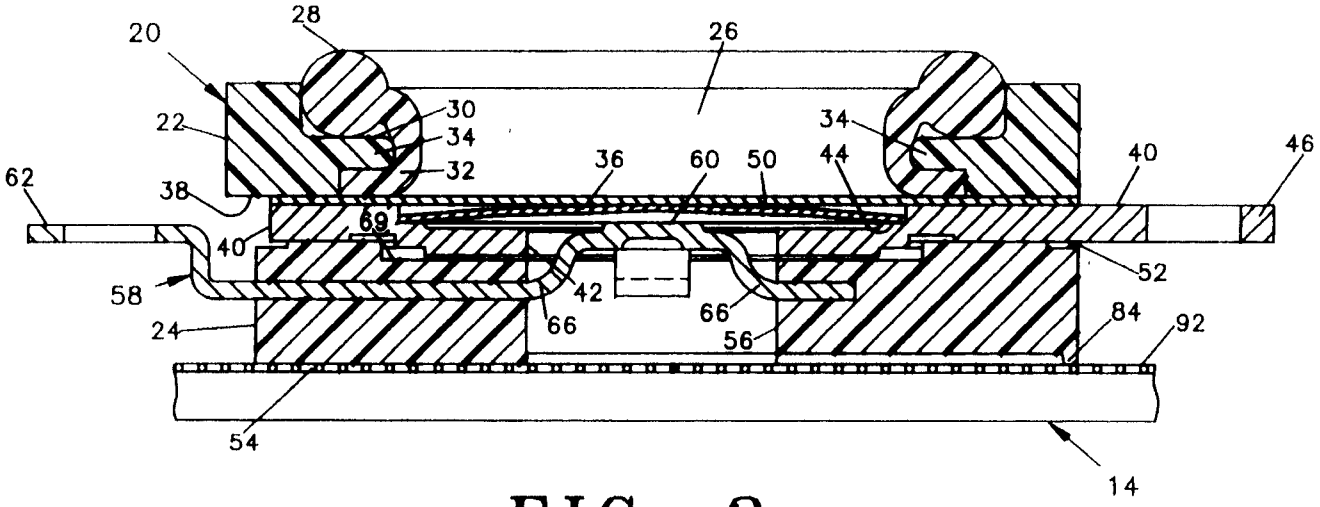
FIG. 2 is a cross sectional view of a pressure switch taken on line 2—2 of FIG. 1.
Figure 3:
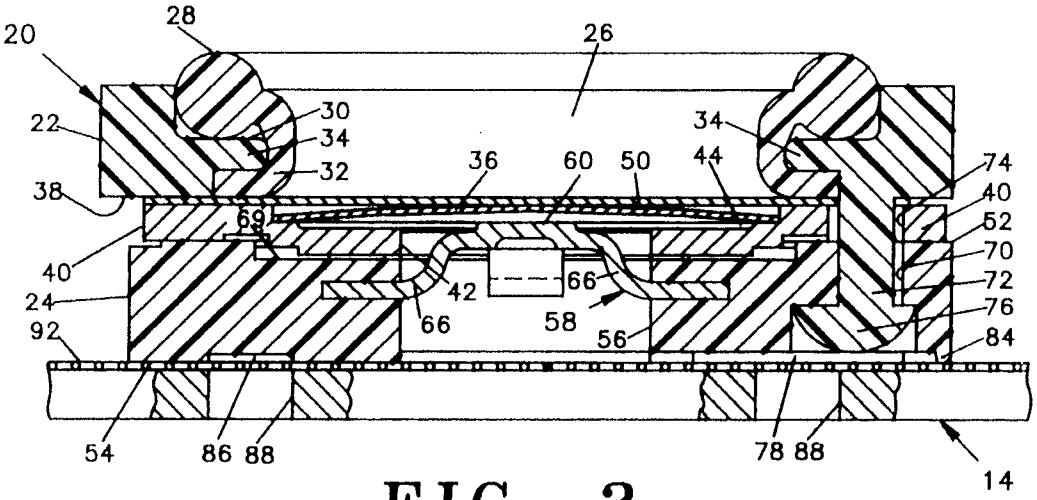
FIG. 3 is a cross sectional view of a pressure switch taken on line 3—3 of FIG. 1.

Pressure responsive switch 20, as best seen in FIGS. 2 and 3, comprises first and second housing members 22 and 24 formed of suitable electrically insulative material, preferably a readily moldable plastic material. Housing member 22 is formed with a fluid receiving opening 26 and has a flexible annular O-ring type seal member 28 received on an O-ring seat 30 formed in housing member 22 around opening 26. Seal member 28 is shown having a neck and flange portion 32 which is captured under shelf 34 to lock seal member 28 in place. A seal member of this type is shown and described in U.S. Pat. No. 5,015,808, assigned to the assignee of the present invention, to which reference may be had for further details. It should be realized, however that other suitable sealing means can be used if so desired.

A fluid sealing membrane 36 of Kapton or other suitable material is placed between the lower surface 38 of housing member 22 and an electrically conductive terminal member 40. Terminal member 40 has a centrally located aperture 42 and a disc receiving seat 44. Terminal member 40 extends laterally away from the housing members in a first direction to form a terminal connection point 46 with electrical connecting point 48 (FIG. 1) of lead frame 12 mounted on bracket 14. An electrically conductive, pressure responsive snap acting disc 50, of stainless steel or other suitable material, is disposed on seat 44 with its at rest convex surface facing upwardly. Disc 50, when subjected to a preselected pressure level through membrane 36 will snap to an opposite concave surface configuration as will be described in further detail below.

Second housing member 24, having upper and lower surface portions 52 and 54 respectively is formed with a cavity 56 and an electrically conductive stationary contact member 58 extending into the cavity and having a contact portion 60 disposed within aperture 42 of terminal and disc seat member 40 and being spaced a selected distance in the order of 0.012 inches below the central portion of the at rest disc 50 so that when the disc snaps to its concave configuration it will electrically connect terminal 40 with stationary contact member 58. Contact member 58 is preferably insert molded in housing member 24 and has a terminal connection point 62 extending laterally in a second direction, opposite the first direction for connection with connecting point 64 of lead frame 12. Although terminal members are shown attached to two lead frame connecting points (48 and 64) it will be appreciated that, if desired, one terminal could be connected to a lead frame connecting point and the other could be connected to ground through bracket 14. Contact portion 60 has a plurality of fingers 66 emanating therefrom into the wall of housing member 24 to securely support contact portion 60 while at the same time permitting calibration by bending legs 66 until central portion 60 is positioned in its selected position.

Figure 4:
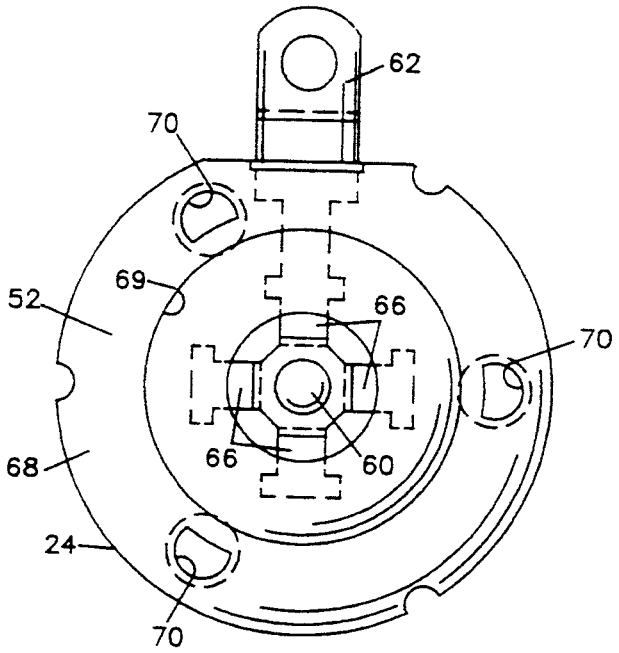
FIGS. 4 and 5 are top and bottom plan views of the bottom or second housing member of the FIGS. 2 and 3 pressure switch.

Top surface 52 of housing member 24, as seen in FIG. 4, is generally circular in top plan view and has a generally annular bearing surface 68. A recessed well area 69 is formed in top surface 52 to accommodate a central portion of member 40 which is formed into a disc seat and provided with space to allow the disc to move to its concave shaped configuration (not shown). A plurality of post receiving apertures 70 are formed through housing member 24 spaced around the periphery thereof and receive therein respective posts 72 (one being shown in FIG. 3) depending from first housing member 22. Posts 72 are received through bores 74 in terminal and disc seat member 40 and corresponding bores or slots in membrane 36 and are deformed at 76 to lock first and second housing members together with membrane 36, disc 50 and terminal and disc seat member 40 sandwiched therebetween.

Figure 5:
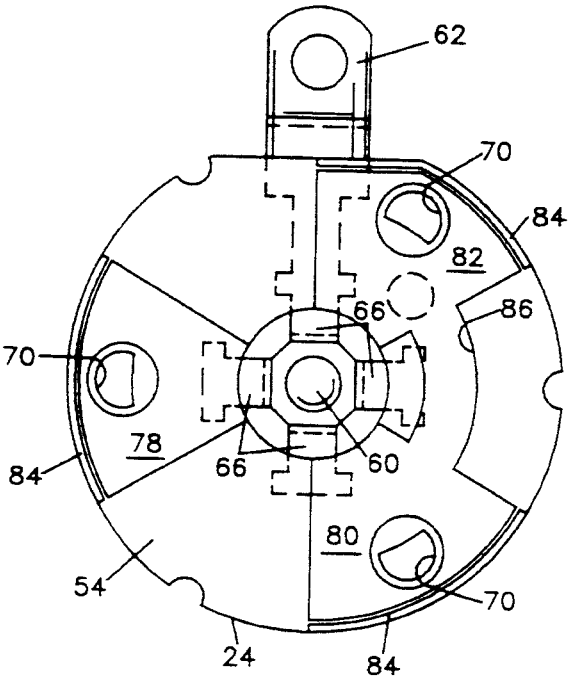

As seen in FIG. 5, lower surface 54 of second housing member 24 is generally circular in top plan view and is formed with a plurality of sector shaped portions 78, 80 and 82 recessed from the remainder of surface 54 by approximately 0.004 inches. The particular number of recesses employed is a matter of choice, however it is preferred to align the post receiving apertures with the recesses to provide extra space in the event that the head 76 of the post should protrude slightly beyond the adjacent bottom surface of the housing. That is, if head 76 projected beyond the non-recessed surface portion it would interfere with the fluid seal between the switch and bracket 14. In the embodiment shown three posts 70 are provided so that six alternating high and low surface portions are convenient, each being approximately 60°. A sealing rib 84 is formed along the outer periphery of each of the recessed portions 78, 80 and 82 so that when attached to bracket 14, as shown in FIGS. 3 and 4, the recessed areas will be totally enclosed with respect to the environs outside the switch.

Recessed portions 80 and 82 are connected by channel 86 having a width at least as wide as the diameter of a bore 88 provided in bracket 14 to be discussed below. Channel 86 can be of any configuration, but may conveniently be shaped to extend in a direction of an arc of a circle, having an inner and outer diameter selected to accommodate bore 88 even if the switch is oriented angularly slightly clockwise or counterclockwise with respect to a line drawn between connection points 48, 64 of lead frame 12.

Figure 6:
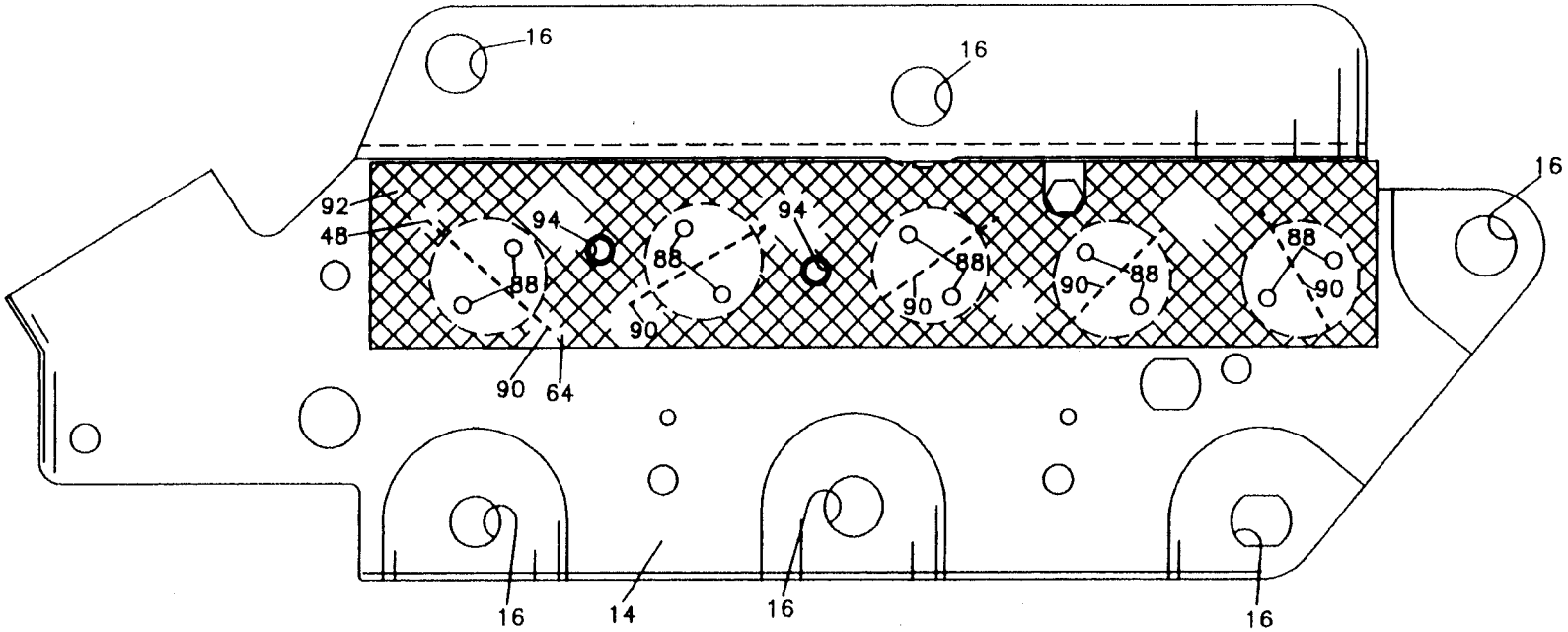
FIG. 6 is a view similar to FIG. 1 of the mounting bracket of the pressure switch assembly shown with a layer of filter material disposed at the pressure switch stations.

With particular reference to FIG. 6, a pair of bores 88 in bracket 14 is provided at each switching station at opposite sides of a dashed line 90 which corresponds to the orientation of the leads or connection points of lead frame 12 to which the switches will be connected. Bores 88 are also equidistant from connection points 48, 64 on line 90 a distance selected so that when a switch 20 is connected to the connection points of lead frame 12 one of the pair of bores 88 will be aligned with channel 86 whether terminal connection point 46 is connected to lead connection point 48 or whether the switch is turned 180° so that the terminal connection point 62 is connected to lead connection point 48.

A layer of filter material 92 formed of suitable material such as woven stainless steel wire or nylon fibers having a selected weave, mesh and opening size to prevent passage of particles larger than a given size, is placed between bracket 14 and switches 20 so that fluid entering the recessed area of the switch via bores 88 will be filtered by layer 92 with the fluid passing through the layer in a direction perpendicular to the surface thereof preventing particles having a minor dimension larger than a selected size from entering the switching chamber formed between disc 50 and contact 60 in the space defined by the walls of aperture 42 and cavity 56. Layer 92 is held in its selected location by staking pins (not shown) which extend from overmolded lead frame 12 through bores 94 and bracket 14 and corresponding holes in layer 92. After attaching lead frame 12 to bracket 14 the staking pins are deformed to lock the parts together.

The above structure provides a vent path to allow the switch to maintain its designed performance characteristics, i.e., actuation/release pressures, response times, endurance life, etc., while providing enhanced contamination resistance.

Figure 7:
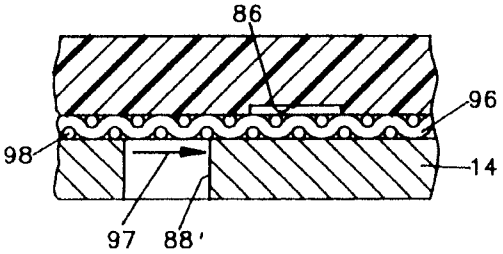
FIG. 7 is a broken away cross section view of a modification of the invention shown in FIGS. 1-6.

In a modified embodiment, the location of bores 88 is changed so that the bores are in alignment with the non-recessed bottom surface 54 so that the fluid is restricted to flowing parallel to the surface of layer 92 through the weave of the filter material. For example, as shown in FIG. 7, bore 88' is offset from channel 86 so that fluid received through bore 88' can only reach channel 86 by flowing in a direction indicated by arrow 97 parallel with the planes in which the warp and woof threads 96 and 98, respectively, lie through the weave of the filter layer. The diameter of the warp and woof threads as well as the weave and mesh is chosen to provide filtering of particles having a major dimension larger than a selected size. For example, 70% of the contact gap, or approximately 0.008 inches. This modified embodiment is particularly effective in restricting both minor and major dimensions from entering channel 86. This embodiment may be further modified, if desired, by eliminating bores 88 and 88' and restricting flow to the parallel direction through the filter from a location beyond the outer periphery of the switch on the filter side of the mounting bracket.

As various changes could be made in the above described invention without departing from the scope of the invention, it is intended that all matter contained in the above description as well as shown in the accompanying drawings shall be interpreted as illustrative and not in a limiting sense.

We claim:

1. A pressure responsive switch for use with hydraulic fluid of motor vehicle transmission systems comprising first and second housing members connected to one another and being formed of electrically insulative material and an electrically conductive terminal member disposed between the first and second housing members, the terminal member formed with an opening therethrough and having a disc seat, an electrically conductive disc movable between concave and convex shaped configurations disposed on the disc seat, the first housing member having an hydraulic fluid receiving opening in a top surface thereof, the opening being sealed from and in pressure communication with the disc, the second housing having a top and bottom surface, a cavity formed in the top surface, an electrically conductive stationary contact member mounted in the second housing and extending into the cavity, the disc adapted to move into and out of engagement with the stationary contact member; the cavity, the opening in the terminal member and the disc forming a switching chamber, a mounting bracket received over the bottom surface of the second housing member and being adapted to attach the switch to a transmission housing, a vent path to permit flow of fluid into and out of the switch chamber comprising a recess formed in the bottom surface of the second housing member in communication with the cavity and an aperture formed through the bracket in communication with the recess, the outer periphery of the bottom surface of the second housing being in sealing engagement with the bracket.

2. A pressure responsive switch according to claim 1 in which the aperture formed in the bracket is in alignment with the recess.

3. A pressure responsive switch according to claim 1 in which the aperture formed in the bracket is offset from the recess.

4. A pressure responsive switch according to claim 1 including a layer of filter material placed between the bracket and the bottom surface of the second housing member.

5. A pressure responsive switch according to claim 3 including a layer of filter material formed of fibers lying in a plane generally parallel to a plane in which the layer lies and the layer is placed between the bracket and the bottom surface such that the fluid flowing through into the vent path is directed through the filter material at an angle generally parallel to the plane in which the layer lies.

6. A pressure responsive switch according to claim 2 including a layer of filter material formed of fibers lying in a plane generally parallel to a plane in which the layer lies and the layer is placed between the bracket and the bottom surface such that the fluid flowing through into the vent path is directed through the filter material at an angle generally perpendicular to the plane in which the layer lies.

7. A pressure responsive switch according to claim 4 in which the layer of filter material comprises fibers woven together.

8. A pressure responsive switch assembly for use with hydraulic fluid of motor vehicle transmission systems comprising a lead frame formed of electrically conductive material encased in electrically insulative material, the lead frame provided with at least one switch receiving aperture, at least one electrical lead forming a connection point extending into the at least one aperture, a bracket for mounting the switch assembly to a transmission housing, the bracket overlying the encased lead frame and each switch receiving aperture, a pressure responsive switch received in the at least one aperture, the switch having first and second housing members each having an opening extending from a top surface of a respective housing member to a bottom surface thereof, the housing members each formed of electrically insulating material and being attached to one another, means to place the opening in the first housing in communication with a hydraulic fluid source, a first electrically conductive terminal member disposed between the first and second housing members, the terminal extending laterally from the switch in a first direction, a second electrically conductive terminal member mounted in the second housing member, the second terminal extending laterally from the switch in a second direction, one of the first and second terminals aligned with and connected to the connection point, and a movable electrically conductive member movable in dependence upon the pressure level of the hydraulic fluid source between a first position in which an electrically conductive path exists between the first and second terminals and a second position in which the electrically conductive path between the first and second terminals is interrupted, the bottom surface of the second housing member being generally circular in plan view and having a selected member of generally sector shaped alternating high and recessed surface areas with a sealing rib formed along the outer periphery of the recessed surface areas, the recessed areas being in communication with the opening in the second housing member, at least one arc shaped recessed channel formed through a high surface area to two adjacent low surface areas on one side of a line passing through the laterally extending terminals and a recessed surface area disposed on another side of said line, and first and second apertures formed through the bracket in alignment with each switch receiving aperture, one of the first and second apertures in alignment with one of the arc shaped recessed channel and a recessed surface area and the other of the first and second apertures in alignment with the other of the arc shaped channel and the recessed surfaced area, thereby forming a vent path through apertures in the bracket, the arc shaped channel and the recessed surface area to the opening in the second housing member.

9. A pressure responsive switch assembly according to claim 8 including a layer of filter material placed between the bracket and the bottom surface of the second housing member.

10. A pressure responsive switch assembly according to claim 8 including a layer of filter material formed of fibers lying in a plane generally parallel to a plane in which the layer lies and the layer is placed between the bracket and the bottom surface such that fluid flowing into the vent path is directed through the filter material at an angle generally perpendicular to the plane in which the layer lies.

11. A pressure responsive switch assembly according to claim 8 including a layer of filter material formed of fibers lying in a plane generally parallel to a plane in which the layer lies and the layer is placed between the bracket and the bottom surface such that fluid flowing into the vent path is directed through the filter material at an angle generally parallel the plane in which the layer lies.

12. A pressure responsive switch for use with hydraulic fluid of motor vehicle transmission systems comprising a housing member formed of electrically insulative material having a top and bottom surface and having a cavity in communication with the top surface and an electrically conductive terminal member disposed within the housing member extending into the cavity, the terminal member formed with an opening therethrough and having a disc seat, an electrically conductive disc movable between concave and convex shaped configurations disposed on the disc seat, the cavity at the top surface forming an hydraulic fluid receiving opening, the opening being sealed from and being in pressure communication with the disc, an electrically conductive stationary contact member mounted in the housing member and extending into the cavity spaced from the terminal member, the disc adapted to move into and out of engagement with the stationary contact member; the cavity, the opening in the terminal member and the disc forming a switching chamber, a mounting bracket received over the bottom surface of the housing member and being adapted to attach the switch to a transmission housing, a vent path to permit flow of fluid into and out of the switch chamber comprising a recess formed in the bottom surface of the housing member in communication with the cavity, the outer periphery of the bottom surface of the housing member being in sealing engagement with the bracket and a layer of filter material placed between the bracket and the bottom surface of the housing.

13. A pressure responsive switch according to claim 12 including a layer of filter material formed of fibers lying in a plane generally parallel to a plane in which the layer lies and the layer being placed between the bracket and the bottom surface such that the fluid flowing through into the vent path is directed through the filter material at an angle generally parallel to the plane in which the layer lies.

* * * * *